United States Patent [19]

Bayham

[11] 4,240,481

[45] Dec. 23, 1980

[54] SEAL FOR FLEXIBLE CONTAINER HAVING FLEXIBLE, GENERALLY CONICAL PORTIONS

[75] Inventor: Edward L. Bayham, Mundelein, Ill.

[73] Assignee: Baxter Travenol Laboratories, Inc., Deerfield, Ill.

[21] Appl. No.: 17,633

[22] Filed: Mar. 5, 1979

[51] Int. Cl.[3] ..... B65D 17/00

[52] U.S. Cl. ..... 150/8

[58] Field of Search ..... 150/8; 128/214 D, 272, 128/DIG. 24

[56] References Cited

U.S. PATENT DOCUMENTS

| | | | |
|---|---|---|---|
| 3,205,889 | 9/1965 | Alder | 150/8 X |
| 3,509,879 | 5/1970 | Bathish . | |
| 3,977,553 | 8/1976 | Cornett | 215/249 |
| 4,114,669 | 9/1978 | Bishop | 150/8 |

FOREIGN PATENT DOCUMENTS 2312263 12/1976 France .

*Primary Examiner*—Donald F. Norton

*Attorney, Agent, or Firm*—Paul C. Flattery; Garrettson Ellis

[57] ABSTRACT

An openable seal member for a container includes a tube extending across the sealed area of the container for flow communication between the interior and exterior thereof. A flexible plastic pocket member seals and encloses the outer end of the tube. Tear means are provided for opening the pocket member, comprising a circumferential line of tearing weakness positioned about the pocket member in transverse relation to the longitudinal axis of the tube. In accordance with this invention, a flexible, generally conical portion is positioned between the outer end of the tube and the tear means, with the conical portion diverging outwardly and constituting an inner portion of the pocket member, to define upon opening of the seal member, an enlarged, protective area surrounding the outer end of the bore of the tube.

21 Claims, 4 Drawing Figures

FIG. 1
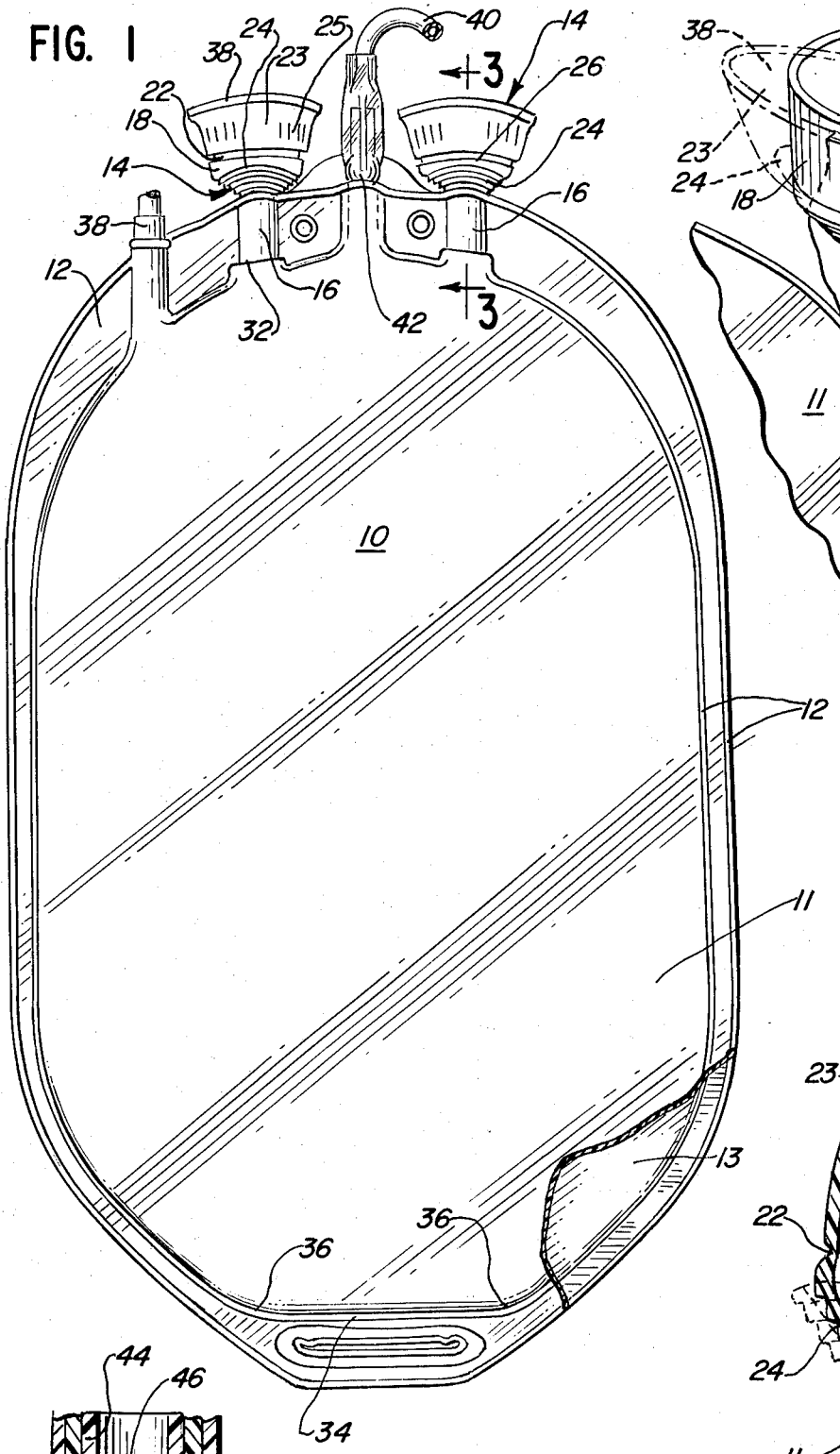
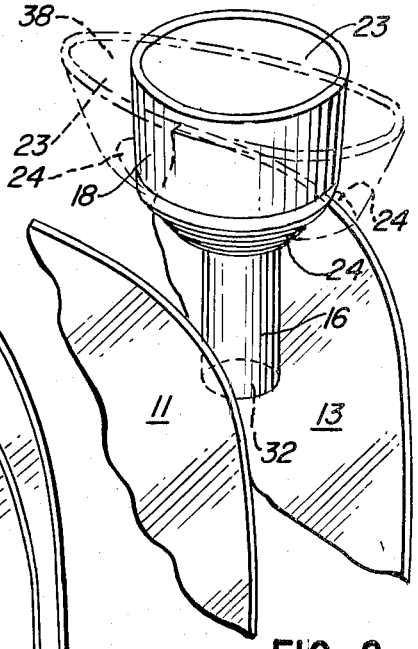
FIG. 2
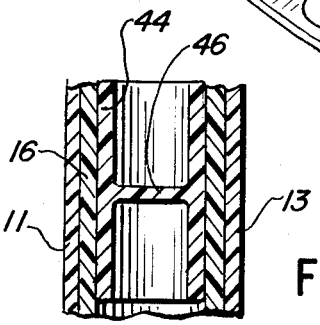
FIG. 4
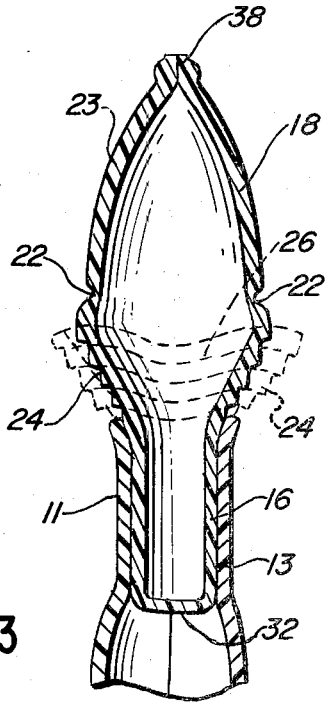
FIG. 3

SEAL FOR FLEXIBLE CONTAINER HAVING FLEXIBLE, GENERALLY CONICAL PORTIONS

BACKGROUND OF THE INVENTION

In French Patent Publication No. 2,312,263, a container for blood discloses a tear seal which comprises a tube passing through the heat seal at the periphery of the container, the tube being sealed at its outer end by a pouch or chamber which is made from the bag material. The pouch or chamber defines a line of tearing weakness which permits the removal of the pouch for access to the tube.

Since it is generally desired for such containers to be sterile prior to opening, and then highly aseptic after opening, a problem exists in the French patent in that non-sterile outer portions of the bag are, after opening of the pouches by tearing away, very close to the exposed outer end of the tube. As a result, an increased risk exists of exposure of the tube to contamination.

Furthermore, the container of the French patent exhibits the characteristic of sequestering blood cells or the like in the inner end of each access tube, because the diaphragm sealing the access tube is positioned outwardly from the inner tube end, providing a chamber capable of retaining a small amount of blood cells during the centrifugation process, to which blood bags are normally subjected during blood processing steps.

The container of this invention provides advantages over the containers of the prior art, coupling easy and optionally complete removal of the outer portion of the sealing pouch, coupled with a better probability of retention of aseptic conditions after opening. Also, the presence of leaks in the seal is more detectable.

DESCRIPTION OF THE INVENTION

In accordance with this invention, an openable seal member for a container comprises a tube extending across a sealed area of the container for flow communication between the container interior and the exterior. A flexible plastic pocket member seals and encloses the outer end of the tube. Tear means for opening the pocket member for access to the tube are provided, with the tear means comprising a circumferential line of tearing weakness, positioned about the pocket member in transverse relation, and preferably generally normal relation, to the longitudinal axis of the tube.

By this invention, a flexible, generally conical portion is positioned between the outer end of the tube and the tear means, being preferably carried at the outer end of the tube. The conical portion diverges outwardly in the direction away from the container, and constitutes an inner portion of the pocket member, to define, upon opening of the seal member, an enlarged, protective area surrounding the outer end of the bore of the tube.

The flexible, conical portion, in sealed configuration, is preferably retained by the remainder of the pocket member in a generally oval cross-sectional shape. The flexible, conical portion is capable, upon opening of the seal member by rupturing of the tear line, of springing outwardly into a more circular configuration for added aseptic protection of the outer end of the bore of the tube.

The pocket member is preferably capable of being squeezed flat by the fingers for gripping and rupturing of the tear means.

It is also preferred for a rupturable diaphragm to be positioned at the inner end of the tube, so that the contents of the container cannot become entrapped in the tube prior to rupturing oof the diaphragm.

Referring to the drawings,

FIG. 1 is a plan view of a blood bag having a pair of the openable seal members of this invention, with some portions broken away.

FIG. 2 is an exploded, fragmentary perspective view of one of the seal members of this invention and part of its associated container, prior to assembly.

FIG. 3 is a longitudinal sectional view of the container of this invention taken along line 3—3 of FIG. 1.

FIG. 4 is a fragmentary vertical sectional view of an alternate embodiment of this invention.

Referring to the drawings, container 10, which may be a blood bag, is made of a pair of plastic sheets 11, 13 sealed together by a heat seal area 12 about the periphery of the bag. Sterile, openable seal members 14 are made in accordance with this invention.

Seal members 14 each comprise a tube 16 extending across seal area 12, for flow communication between the interior of the bag 10 and the exterior.

A flexible plastic pocket member 18 sealingly encloses the outer end of each tube 16. In the embodiment shown, pocket member 18 is formed integrally with tube 16, for example by molding and, as shown in FIG. 2, is initially formed as a cylindrical extension of tube 16 having an open, outer end which is then sealed in a later manufacturing step at its outer end.

The inner portion of pocket member 18 defines a flexible, generally conical portion 24 including circumferential, ridged rings 26 about the exterior. As shown in FIGS. 1 and 3, the conical portion 24, in sealed configuration, is retained by the remainder of the pocket member in a generally oval shape. Also, the conical member 24 is an integral part of tube 16, being connected at the outer end thereof. Also, squeezing of pocket member 18 without tearing is a test for seal integrity through compression of the air inside.

Outer, flattenable portion 23 of pocket member 18 defines a plurality of finger-gripping ridges 25, positioned in generally longitudinal relation to the axis of the tube 16. This facilitates the grasping and flattening of pocket member 18 for the tearing of it apart.

Tear means are provided for opening the pocket member for access to the tube. This tear means comprises rupturable line 22 comprising a circumferential line of tearing weakness in normal relation to the longitudinal axis of tube 16. Accordingly, one can tear line 22 apart with the fingers, removing the upper portion 23 of pocket member 18, to expose the outer end of tube 16. When this takes place, as shown in phantom in FIGS. 2 and 3, the conical portion 24, which is generally in an oval shape while sealed, can spring outwardly to a more circular configuration, to aseptically protect the open, outer end of tube 16 with a sterile field around the outer end of the tube.

The outer portion 23 of pocket member 18 may be flexible, to be capable of being squeezed flat by the fingers for gripping.

Rupturable diaphragm 32 is shown in FIGS. 1 and 3 to be positioned at the inner end of tube 16. This provides manufacturing advantages, and also prevents the contents of the container, for example red or white blood cells, from becoming entrapped in the tube prior to rupturing of the diaphragm. When a spike on a blood set or the like penetrates tube 16, it easily passes through diaphragm 32 for final opening of the bag.

As shown in FIG. 1, bag 10 defines a generally rounded tail end as at 34, with end corner angles 36 no less than 120°, to avoid entrapment of blood during processing of the bag, particularly during centrifugation. Instead, the generally rounded configuration includes only two seal line angles 36 of about 120° to 160° or so, e.g., 133°, for reduction of the problem of entrapment of blood components during centrifugation and the like, as disclosed in my U.S. patent application Ser. No. 937,008, filed Aug. 25, 1978.

Blood bag 10 also carries a donor tube 38 (broken away for convenience of disclosure) which may be of conventional design, and a second tube 40 for communication with another blood bag in the conventional manner of multiple blood bags in technology. A breakaway valve member 42 is provided, being of the type as described in the Carter, et al. U.S. Ser. No. 15,395, filed Feb. 26, 1979, although other conventional valving members may be used as a substitute if desired.

The blood bag of this application may be manufactured by assembling the seal member 14 of this invention as shown in FIG. 2 with the pre-formed tube 16 and pocket member 18, open at the top. Tube 16 is positioned between the periphery of a pair of heat-sealable plastic sheets 11, 13. A mandrel may be inserted through pocket 18 into the outer end of tube 16, preferably to the fullest extent permitted by diaphragm 32. Following this, heat seal dies may close around the periphery of the container to form heat seal area 12, and to seal tube 16 into permanent relation with the container 10 in such a manner so that one end of tube 16 is in flow communication with the interior of bag 10 (when diaphragm 32 is ruptured) and the other end of tube 16 is capable of communication with the exterior. Thereafter, the mandrel may be withdrawn from tube 16, and in a second heat sealing step, the outer portion of pocket member 18 may be sealed with heat seal 38 to seal the container.

The container of this invention may utilize the fabrication method described and claimed in my copending application Ser. No. 017,529, filed Mar. 5, 1979 filed on the same date as this present application, and entitled "Seal for Flexible Container and Method".

It is also contemplated that the openable seal member of this invention can be used on structures other than flexible bags and the like. For example, it is easily adapted for use as part of an administration set for blood or parenteral solution, where a tube passes through a seal in the set, and is closed at its outer end with a pocket member analogous to pocket member 18. Similarly, the openable seal member of this invention can be used on dialyzers and oxygenators for blood or other medical devices.

If desired, diaphragm 32 may be omitted from tube 16, and a second inner sleeve 44 may be inserted and sealed in the bore of tube 16 as in FIG. 4. The inner sleeve 44 may define a rupturable diaphragm 46 which is positioned between the ends of tube 16. This permits efficient manufacturing techniques, coupled with an intermediately located diaphragm.

The above has been offered for illustrative purposes only, and is not intended to limit the invention of this application, which is as defined in the claims below.

That which is claimed is:

1. An openable seal member for a container which comprises a tube adapted to extend across a sealed area of the container for flow communication between said container interior and the exterior; a flexible plastic pocket member sealing and enclosing the outer end of said tube; tear means for opening said pocket member for access to said tube, said tear means comprising a circumferential line of tearing weakness positioned about said pocket member in transverse relation to the longitudinal axis of said tube, the improvement comprising, in combination:

a flexible, generally conical portion positioned between the outer end of said tube and said tear means, diverging outwardly and constituting an inner portion of said pocket member, to define upon opening of said seal member, an enlarged, protective area surrounding the outer end of the bore of said tube.

2. The openable seal member of claim 1 in which said flexible conical portion, in sealed configuration, is retained by the remainder of said pocket member in a generally oval shape, said flexible conical portion being capable, upon opening of said seal member by rupturing of said tear line, of springing outwardly into more circular configuration.

3. The openable seal member of claim 2 in which said flexible, conical member is carried at the outer end of said tube.

4. The openable seal member of claim 2 in which said pocket member is capable of being squeezed flat by the fingers for gripping and rupturing of said tear means.

5. The openable seal member of claim 2 carried by a flexible, collapsible container.

6. The container of claim 2 which includes a rupturable diaphragm positioned at the inner end of said tube, whereby the contents of said container cannot become entrapped in said tube prior to rupturing of the diaphragm.

7. The container of claim 2 in which the portion of said pocket member positioned outwardly from said tear means defines a plurality of finger-gripping ridges positioned in generally longitudinal relation to the axis of said tube.

8. The seal member of claim 7 in which said conical member defines on its exterior a plurality of ridged rings about said tube.

9. The openable seal member of claim 1 which includes a rupturable diaphragm at the end of said tube opposed to said flexible, generally conical portion.

10. An openable seal member carried at one end by a flexible, collapsible blood bag defining a peripheral seal, which comprises a tube extending across said seal of the container for flow communication between said container interior and the exterior; a flexible plastic pocket member sealing and enclosing the outer end of said tube; tear means for opening said pocket member for access to said tube, said tear means comprising a circumferential line of tearing weakness positioned about said pocket member in generally normal relation to the longitudinal axis of said tube, the improvement comprising, in combination:

a flexible, generally conical portion positioned between the outer end of said tube and said tear means, diverging outwardly and constituting an inner portion of said pocket member, to define upon opening of said seal member, when sterile, an enlarged, protective sterile area surrounding the outer end of the bore of said tube.

11. The openable seal member of claim 10 in which said flexible, conical portion, in sealed configuration, is retained by the remainder of said pocket member in a generally oval shape, said flexible conical portion being capable, upon opening of said seal member by rupturing of said tear line, of springing outwardly into more circular configuration.

12. The openable seal member of claim 11 in which said flexible, conical member is carried at the outer end of said tube.

13. The openable seal member of claim 11 in which said pocket member is capable of being squeezed flat by the fingers for gripping and rupturing of said tear means.

14. The container of claim 11 which includes a rupturable diaphragm positioned at the inner end of said tube, whereby the contents of said container cannot become entrapped in said tube prior to rupturing of the diaphragm.

15. The container of claim 14 in which the portion of said pocket member positioned outwardly from said tear means defines a plurality of finger-gripping ridges positioned in generally longitudinal relation to the axis of said tube.

16. The seal member of claim 15 in which said conical member defines on its exterior a plurality of ridged rings about said tube.

17. The openable seal member of claim 10 which includes a rupturable diaphragm positioned at the inner end of said tube, whereby the contents of said container cannot become entrapped in said tube prior to rupturing of the diaphragm.

18. An openable seal member carried at one end by a flexible, collapsible blood bag defining an edge seal, which comprises a tube extending across said seal of the container for flow communication between said container interior and the exterior; a flexible plastic pocket member sealing and enclosing the outer end of said tube; tear means for opening said pocket member for access to said tube, said tear means comprising a circumferential line of tearing weakness positioned about said pocket member in generally transverse relation to the longitudinal axis of said tube; the improvement comprising, in combination: a portion positioned between the outer end of said tube and said tear means, said portion extending substantially in a generally circumferential direction transverse to the longitudinal axis of said tube, and constituting an inner portion of said pocket member, whereby said pocket member defines at its inner end a substantial cross section in a generally circumferential direction transverse to the longitudinal axis of said tube, said tube being sealed with a needle-piercable diaphragm, whereby the interior of said pocket member is completely sealed, and contains sufficient gas therein to permit a test for the integrity of the seal of said pocket member by manually squeezing the pocket member to detect compression of the gas inside, said transverse portion defining, upon opening of said seal member, when sterile, a protective, sterile area surrounding the outer end of the bore of said tube.

19. The openable seal member of claim 18 in which said diaphragm is positioned at the inner end of said tube, whereby the contents of said container cannot become entrapped in said tube prior to rupturing of the diaphragm.

20. An openable seal member for a container which comprises a tube adapted to extend across a sealed area of the container for flow communication between said container interior and the exterior; a flexible plastic pocket member sealing and enclosing the outer end of said tube; tear means for opening said pocket member for access to said tube; said tear means comprising a circumferential line of tearing weakness positioned about the pocket member in generally transverse relation to the longitudinal axis of said tube; the improvement comprising, in combination: a portion positioned between the outer end of said tube and said tear means; said portion extending substantially in a circumferential direction transverse to the longitudinal axis of said tube, and constituting an inner portion of said pocket member, whereby said pocket member defines at its inner end a substantial cross-section in a generally circumferential direction transverse to the longitudinal axis of said tube, said tube being sealed with a needle-piercable diaphragm, whereby the interior of said pocket member is completely sealed, and contains sufficient gas therein to permit a test for the integrity of the seal of said pocket member by manually squeezing the pocket member to detect compression of the gas inside, said transverse portion defining, upon opening of said seal member, when sterile, a protective, sterile area surrounding the outer end of the bore of said tube.

21. The openable seal member of claim 20 in which said diaphragm is positioned at the end of said tube opposed to said portion extending substantially in a generally circumferential direction transverse to the longitudinal axis of said tube.

* * * * *